United States Patent [19]

Freling

[11] 4,381,173

[45] Apr. 26, 1983

[54] COOLABLE ROTOR BLADE ASSEMBLY FOR AN AXIAL FLOW ROTARY MACHINE

[75] Inventor: Melvin Freling, West Hartford, Conn.

[73] Assignee: United Technologies Corporation, Hartford, Conn.

[21] Appl. No.: 181,031

[22] Filed: Aug. 25, 1980

[51] Int. Cl.[3] ..... F01D 5/18

[52] U.S. Cl. ..... 416/96 A

[58] Field of Search ..... 416/96 A, 96 R, 97 A, 416/97 R; 415/115

[56] References Cited

U.S. PATENT DOCUMENTS

| | | | |
|---|---|---|---|
| 2,931,623 | 4/1960 | Hyde | 253/39.15 |
| 3,370,830 | 2/1968 | Nickles et al. | 253/39.152 |
| 3,609,059 | 9/1971 | Wagle | 416/95 |
| 3,697,192 | 10/1972 | Hayes | 416/96 R |
| 3,715,170 | 2/1973 | Savage et al. | 416/96 A |
| 3,767,322 | 10/1973 | Durgin et al. | 416/97 |
| 3,836,279 | 9/1974 | Lee | 415/116 |
| 3,902,820 | 9/1975 | Amos | 416/97 |
| 3,967,353 | 7/1976 | Pagnotta et al. | 29/156.8 R |
| 3,973,874 | 8/1976 | Corsmeier et al. | 416/97 |
| 3,994,622 | 11/1976 | Schultz et al. | 416/97 R |
| 4,118,136 | 10/1978 | Corsmeier et al. | 403/386 |
| 4,156,582 | 5/1979 | Anderson | 416/96 R |
| 4,171,184 | 10/1979 | Lings et al. | 416/97 R |

FOREIGN PATENT DOCUMENTS

| | | | |
|---|---|---|---|
| 52-31209 | 3/1977 | Japan | 416/96 A |

*Primary Examiner*—Robert E. Garrett

*Attorney, Agent, or Firm*—Gene D. Fleischhauer

[57] ABSTRACT

A coolable rotor blade assembly 10 of the type adapted for use in an axial flow gas turbine engine is disclosed. The assembly includes a rotor blade 12 and an impingement tube 14. A fiber metal seal 56 is disposed between the base of the rotor blade and the impingement tube. The seal contacts a seat 52 on the rotor blade and a face 54 on the impingement tube. The fiber metal seal has sufficient durability, flexibility, compressibility and density to enable sealing between the rotor blade and the impingement tube in a high temperature environment.

3 Claims, 6 Drawing Figures

FIG. 1
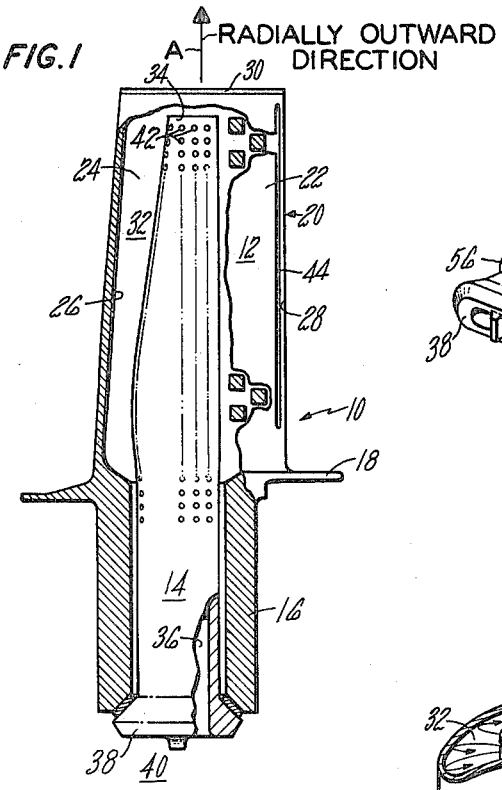
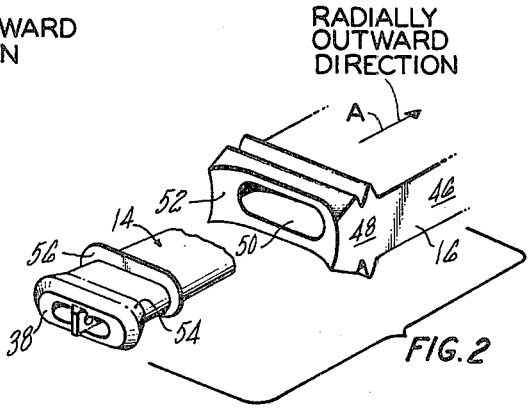
FIG. 2
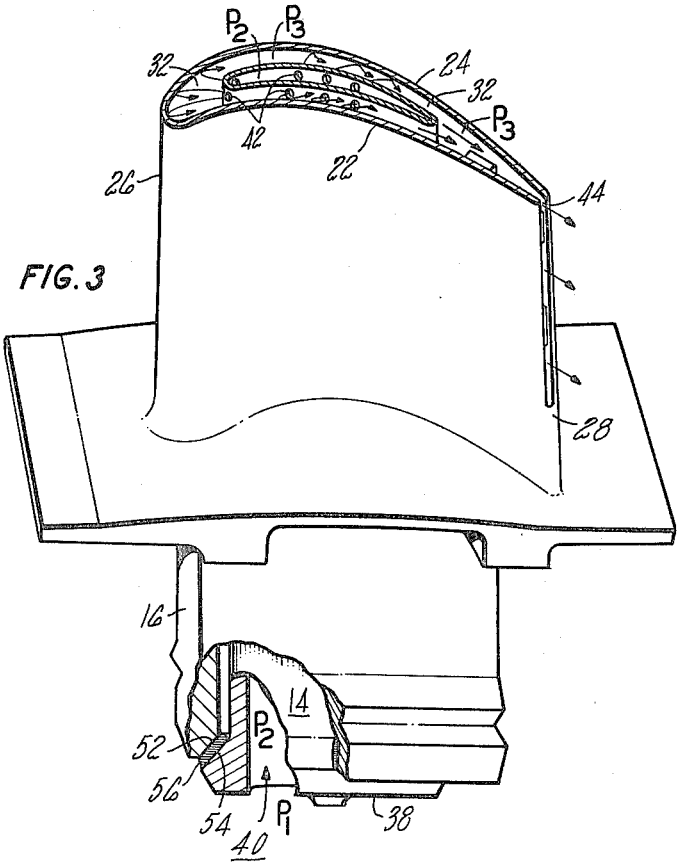
FIG. 3
FIG. 4
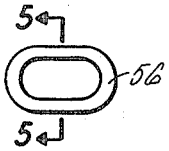
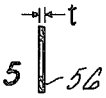
FIG. 5

COOLABLE ROTOR BLADE ASSEMBLY FOR AN AXIAL FLOW ROTARY MACHINE

TECHNICAL FIELD

This invention relates to axial flow rotary machines and more particularly to coolable rotor blade assemblies for use in such machines.

BACKGROUND ART

Axial flow rotary machines typically have an axially extending rotor assembly. The rotor assembly includes a rotor disk and a plurality of rotor blade assemblies extending outwardly from the disk into a working medium flow path. The gases flowing along the working medium flow path may reach temperatures in excess of 2000° F. The rotor blade assemblies are bathed in the hot working medium gases. In modern engines the rotor blades of the rotor blade assemblies are cooled to increase the service life of the blade. An example of such a coolable rotor blade is shown in U.S. Pat. No. 3,994,622 entitled "Coolable Turbine Blade" issued to Schultz et al. In this blade assembly, the rotor blade is hollow and receives an impingement tube. Cooling air is flowed through the impingement tube and caused to impinge on the walls of the rotor blade to effect cooling. The cooling air is discharged typically from the trailing edge of the blade and other locations such as the leading edge region of the blade. In the Schultz et al. structure cooling air is allowed to flow between the base of the rotor blade and the impingement tube to convectively cool the shank of the blade.

In other constructions the flow path between the base of the rotor blade and the base of the impingement tube is eliminated. The base of the rotor blade is provided with a seat and the impingement tube is provided with a conforming face to provide sealing therebetween. Cooling air is flowed into the interior of the impingement tube at reduced rates and through small impingement holes in the tube to form high velocity impingement jets.

DISCLOSURE OF INVENTION

This invention is predicated in part on the discovery that impingement cooling designs of the type discussed which use high velocity jets at a reduced mass flow are severely affected by small increases in back pressure as compared with designs using lower velocity jets at a higher mass flow.

According to the present invention, a fiber metal seal for a coolable rotor blade assembly is disposed between the base of the blade and an impingement tube adapted to receive a cooling fluid to maintain the required pressure difference between the interior of the tube and the blade for effective impingement cooling.

A primary feature of the present invention is a seal disposed between the base of a rotor blade and an impingement tube. The seal is formed of a fiber metal. The base of the rotor blade has a seat adjacent the fiber metal seal. The impingement tube has a face adjacent the fiber metal seal which is adapted to conform to the seat.

A principal advantage of the present invention is the increase in engine efficiency which results from reducing the consumption of cooling air in the rotor blade assemblies of the engine. The service life of the rotor blade is enhanced by decreasing thermal gradients in the trailing edge region of the blade which result from overcooling. The effectiveness of the cooling jets is preserved by avoiding the loss in the required pressure for the jets and by avoiding a leakage flow which interferes with the jets.

The foregoing, and other objects, features and advantages of the present invention will become more apparent in the light of the following detailed description of the preferred embodiment thereof as shown in the accompanying drawing.

BRIEF DESCRIPTION OF DRAWINGS

FIG. 1 is a simplified side elevation view of a rotor blade assembly with a portion of the blade broken away to show an impingement tube and with a portion of the impingement tube broken away to show a portion of the interior thereof;

FIG. 2 is an exploded partial perspective view of the base of the rotor blade assembly showing a portion of the rotor blade and a portion of the impingement tube;

FIG. 3 is a partial perspective view of the rotor blade assembly with a portion of the tip and the base of the rotor blade broken to show the rotor blade and the impingement tube;

FIG. 4 is a plan view of a fiber metal seal;

FIG. 5 is a cross sectional view of the seal taken along the line 5—5 as shown in FIG. 4;

BEST MODE FOR CARRYING OUT THE INVENTION

Figure 6:
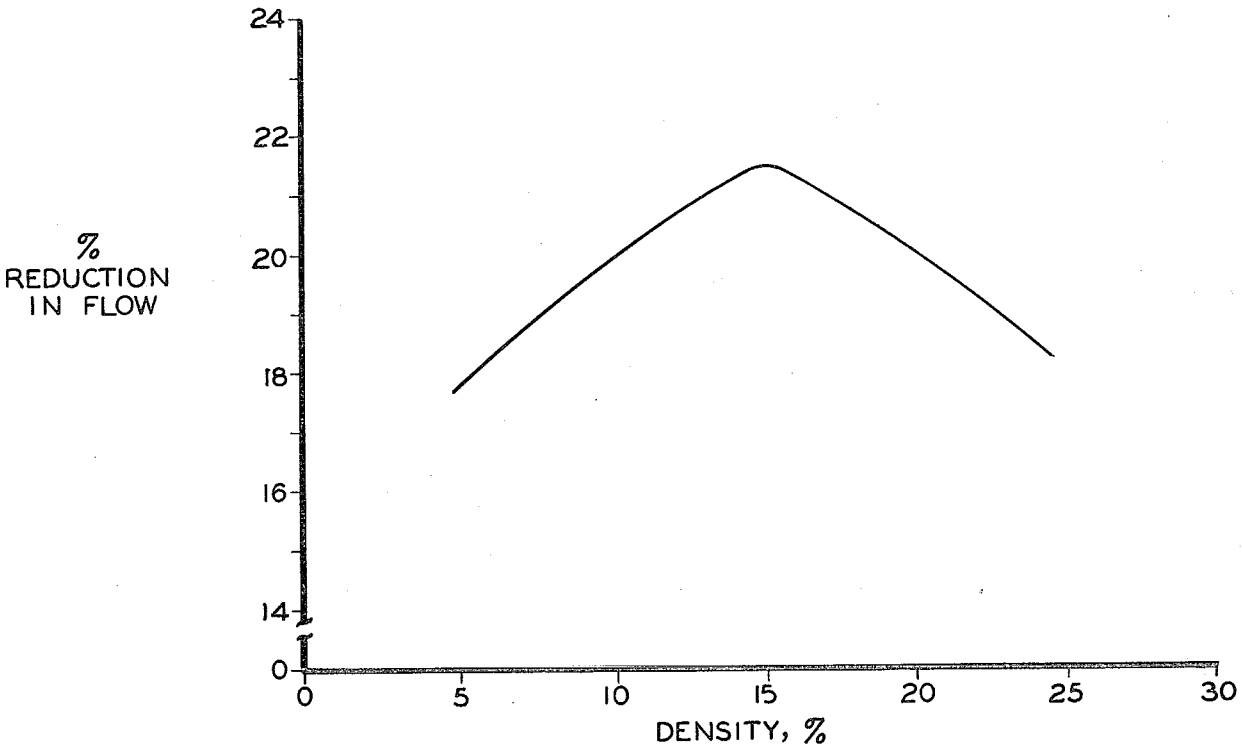
FIG. 6 is a graphical representation of the percent reduction in flow versus the density of the fiber metal seal which occurred during a static flow test of an experimental embodiment.

FIG. 1 shows a rotor blade assembly 10 of the type adapted for use in an axial flow gas turbine engine. The assembly has a spanwise axis A extending in a radially outwardly direction. The assembly is formed of a coolable rotor blade 12 which is hollow and an impingement tube 14. The rotor blade has a base 16, a platform 18 and an airfoil 20. The airfoil 20 is formed of a first wall 22 and a second wall 24 extending in a spanwise direction. The walls are joined one to the other at a leading edge 26 and a trailing edge 28. An airfoil tip, such as the tip cap 30, extends chordwisely to seal the radially outward portion of the blade.

In the installed condition, the impingement tube 14 is spaced from the rotor blade 12 leaving a cavity 32 therebetween. The impingement tube has a first end 34 which is sealed, an internal manifold 36 and a second end 38 which is open. A source for cooling air such as the supply chamber 40 radially inwardly of the rotor blade is in fluid communication with the internal manifold. The impingement tube has a plurality of cooling air holes 42. The impingement tube is in fluid communication with the first wall 22 and the second wall 24 of the airfoil through the plurality of cooling air holes and the cavity 32 between the blade and the tube. The cavity 32 is in fluid communication with the working medium flow path through a plurality of discharge holes 44 in the trailing edge of the airfoil.

FIG. 2 is an exploded perspective view of the base 16 of the rotor blade 12 and the open end 38 of the impingement tube 14. The base of the rotor blade includes a shank portion 46 and a root portion 48. The root portion adapts the rotor blade to engage a rotor disk (not shown). The root portion has an opening 50. A seat 52 surrounds the opening and faces inwardly. The opening and the seat adapt the blade to receive the impingement tube. The impingement tube is adapted by a face 54 to conform to the seat. A fiber metal seal 56 is disposed between the seat of the blade and the face of the tube. In the uninstalled condition, the fiber metal seal lies in a plane. As shown in FIG. 3, the fiber metal seal conforms to the seat in the installed condition.

FIG. 4 is a top view of the fiber metal seal 56 in the uninstalled condition. The fiber metal seal must have compressible faces to conform to the seat of the rotor blade and the face of the impingement tube. The seal must be compressible and not brittle to accept tolerance variations between the blade and the tube. The seal must accommodate temperatures well over 1000° F. and accept mechanical and thermal cyclic stresses. The density of the material must be sufficient to prevent leakage. The fiber metal seal consists of randomly interlocked metal fibers in the form of a sintered and pressed sheet or a sintered and rolled sheet. One satisfactory fiber metal sheet is FELTMETAL ® fiber metal available from the Technetic Division of the Brunswick Corporation, DeLand, Florida. One material known to be effective for the metal alloy from which the fiber metal is made is a nickel chrome alloy stabilized with columbium, such as the DEF-242 alloy (NICHROME V ® alloy) available from the Driver Harris Company, Inc., Harrison, N.J. The elements of the alloy are given as percentages by weight as set forth in Table I.

TABLE I

| | Min. | Max. |
|---|---|---|
| Carbon | — | 0.2 |
| Silicon | 0.90 | 1.50 |
| Columbium | 1.00 | 1.20 |
| Chromium | 17.00 | 22.00 |
| Nickel | remainder | |

As will be realized, a fiber metal seal composed of any density material will reduce the leakage flow between the impingement tube and the rotor blade as compared with the same structure without a fiber metal seal. For example, in a static experiment in which an impingement tube was inserted with a force of one thousand (1000) pounds, a flow test demonstrated that a fiber metal seal having a thickness t of twenty-five thousandths (0.025) of an inch as shown in FIG. 5 reduced the leakage flow by 17% to 21% for a range of densities in the uninstalled seal of five percent (5%) of the alloy density to twenty-five percent (25%) of the alloy density. The results are summarized in FIG. 6. The maximum reduction in leakage flow occurred at a density of 15%.

During operation of the gas turbine engine, the rotor blade assembly 10 is subjected to a rotational force field. As shown in FIG. 3, the force field urges the impingement tube 14 outwardly causing the impingement tube to press against the fiber metal seal 56 and the seal to press against the seat 52 of the blade 12. For example, the pressure against the seal may be as high as four thousand pounds per square inch (4000 psi).

As cooling air at a pressure $P_1$ is flowed from the supply chamber 40, the seal blocks the leakage of cooling air into the cavity 32 along a path between the face 54 of the impingement tube and the seat 52 of the rotor blade. The cooling air is flowed from the supply chamber through the internal manifold 36 of the impingement tube and thence through the plurality of holes 42 of the impingement tube. The holes cause the flowing cooling air to form jets of cooling air. The jets of cooling air flow across the cavity 32 and impinge on the first wall 22 and the second wall 24 of the airfoil such as at the leading edge 26. After impingement, the cooling air is flowed at a pressure $P_3$ in the cavity 32 to the trailing edge region 28 for discharge.

The cooling effectiveness of each cooling air jet is dependent on the velocity of each jet. The velocity of the jet is dependent on the difference of the pressure ($\Delta P = P_2 - P_3$) between the pressure of the cooling air in the internal manifold of the impingement tube ($P_2$) and the pressure of the cooling air in the second cavity ($P_3$). Blocking the leakage of cooling air at the base of the rotor blade between the impingement tube and the blade with the fiber metal seal avoids an increase in the pressure $P_3$ which would decrease the difference in pressure ($\Delta P = P_2 - P_3$). Moreover, blocking the leakage avoids a large increase in the mass flow through the cavity 32 and through the discharge holes 44 in the trailing edge region of the rotor blade. For example, in one construction leakage increased the flow rate through the blade by fifteen percent (15%) above the desired flow rate. The same construction having a fiber metal seal disposed between the seat of the blade and the face of the tube experienced a flow rate increase of 0.2% above the desired flow rate. An increase in the mass flow in the cavity 32 because of leakage between the impingement tube and the blade causes overcooling of the trailing edge region and results in thermal gradients in the rotor blade. These thermal gradients result in thermal stresses which unfavorably affect the service life of the rotor blade. In addition, the increased mass flow in the cavity 32 interferes with the impingement cooling in the platform region of the rotor blade. Thus blocking leakage of cooling air between the impingement tube and the rotor blade maintains (1) the correct mass flow of cooling air through the holes 42, (2) at the correct velocity, and (3) avoids problems associated with increased mass flow.

Although the invention has been shown and described with respect to preferred embodiments thereof, it should be understood by those skilled in the art that various changes and omissions in the form and detail thereof may be made therein without departing from the spirit and the scope of the invention.

I claim:

1. For a gas turbine engine, a coolable rotor blade assembly of the type formed of a hollow rotor blade having an inwardly facing wall and having a base which is adapted by an opening in the base surrounded by an inwardly facing seat to receive an impingement tube, the impingement tube being adapted by a face to conform to the seat, being spaced from the blade to form a cavity therebetween, and in fluid communication at a second pressure with a source for cooling fluid at a first pressure and with the wall of the blade through a plurality of holes and the cavity at a third pressure, the improvement which comprises:

a fiber metal seal disposed between the seat of the blade and the face of the tube wherein the seal blocks the leakage of the cooling fluid between the tube and the blade to maintain the requisite pressure gradient across the tube to the wall for impingement cooling.

2. The coolable blade assembly of claim 1 wherein the seat opens outwardly from the opening and wherein the seal lies in a plane in the uninstalled condition and conforms to the seat in the installed condition.

3. The fiber metal seal of claim 2 wherein the seal has a density of approximately fifteen percent and a thickness of approximately twenty-five thousandths (0.025) of an inch.

* * * * *